United States Patent [19]

Fotiu et al.

[11] 4,413,921

[45] Nov. 8, 1983

[54] COSMETIC PENCIL HAVING A SHARPENABLE POLYETHYLENE CASING

[75] Inventors: Eustace Fotiu, Mahwah, N.J.; Marlene Tietjen, New York; Tibor Goldner, Fresh Meadows, both of N.Y.; Philip Rosenblum, West Orange, N.J.

[73] Assignee: Revlon, Inc., New York, N.Y.

[21] Appl. No.: 168,239

[22] Filed: Jul. 10, 1980

Related U.S. Application Data

[63] Continuation-in-part of Ser. No. 939,887, Sep. 5, 1978, abandoned.

[51] Int. Cl.[3] ..... A45D 40/00; A45D 40/20

[52] U.S. Cl. ..... 401/96; 401/49

[58] Field of Search ..... 401/49, 88, 96, 97, 401/292

[56] References Cited

U.S. PATENT DOCUMENTS

| | | | |
|---|---|---|---|
| 647,181 | 4/1900 | Forsman | 401/96 |
| 2,988,784 | 6/1961 | Lorenian | 401/96 X |
| 3,551,064 | 12/1970 | Bartner | 401/96 |
| 3,551,064 | 12/1970 | Bartner | 401/96 |
| 3,704,071 | 11/1972 | Muller et al. | 401/96 |
| 3,875,088 | 1/1975 | Arons et al. | 401/96 X |
| 3,936,519 | 2/1976 | Crystal | 401/96 X |
| 4,063,828 | 12/1977 | Mukai et al. | 401/96 |

FOREIGN PATENT DOCUMENTS

| | | | |
|---|---|---|---|
| 1461292 | 5/1969 | Fed. Rep. of Germany | 401/96 |
| 2433290 | 1/1975 | Fed. Rep. of Germany | 401/96 |
| 2718957 | 8/1978 | Fed. Rep. of Germany . | |
| 1055450 | 2/1954 | France | 401/96 |
| 2055894 | 5/1971 | France | 401/96 |
| 2359586 | 4/1979 | France . | |
| 579860 | 7/1958 | Italy | 401/96 |
| 45-19124 | 6/1970 | Japan | 401/96 |
| 1538188 | 1/1979 | United Kingdom . | |

*Primary Examiner*—Steven A. Bratlie

[57] ABSTRACT

A cosmetic pencil capable of being sharpened in a pencil sharpener the pencil having a cosmetic core and a casing comprising a homogeneous blend of materials including a major portion of polyethylene whose density is in the range of between about 0.88 g/cc and 0.99 g/cc; a hardness in the range of between about 35–70 as measured by ASTM D-2240; and a softening point above 60° C.

23 Claims, 6 Drawing Figures

FIG. 1
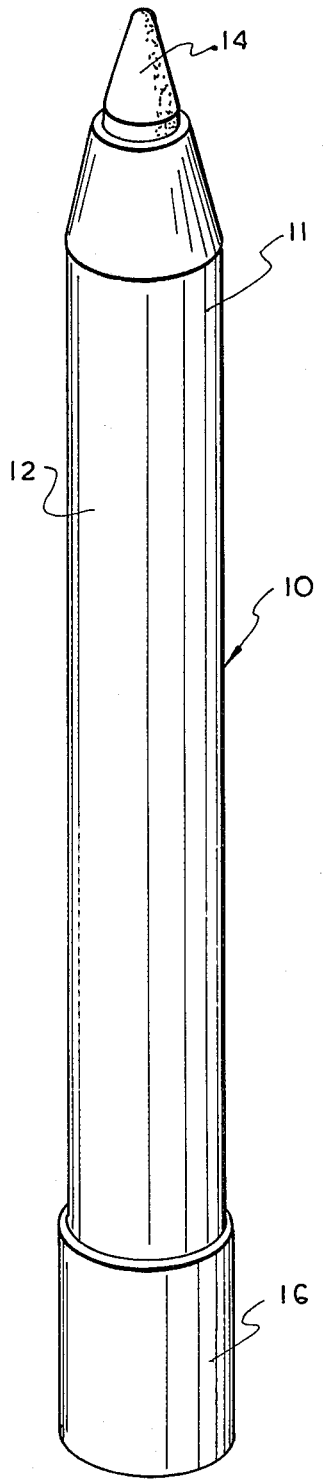
FIG. 2
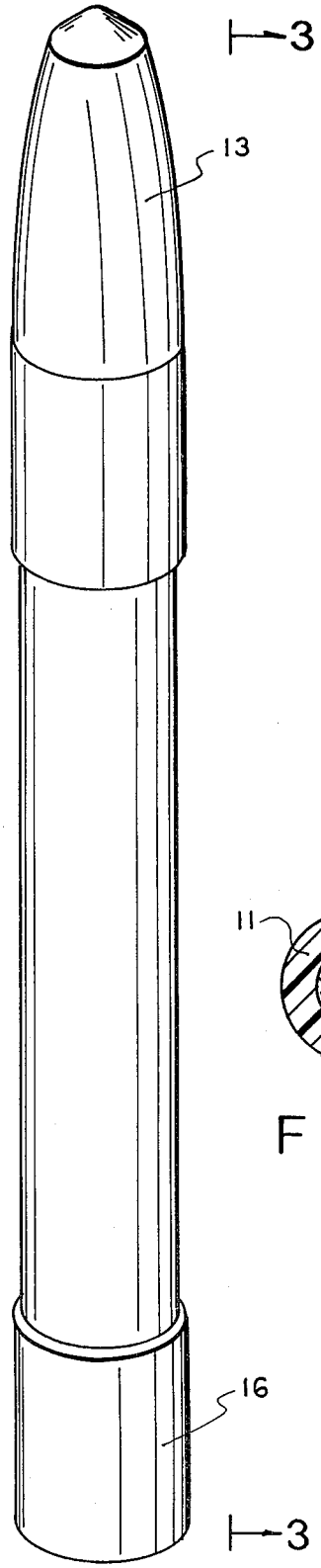
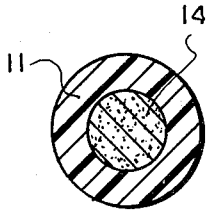
FIG. 6

COSMETIC PENCIL HAVING A SHARPENABLE POLYETHYLENE CASING

This application is a continuation-in-part of U.S. patent application Ser. No. 939,887, filed Sept. 5, 1978, now abandoned.

The present invention relates to cosmetics. It particularly relates to cosmetic pencils and to processes for their manufacture.

At present, cosmetic pencils are comprised of a cosmetic core inside a wood casing. Wood, being a natural substance, varies in composition and properties. These properties may result in the penetration into the wood of ingredients comprising the cosmetic and/or the leaching of substances from the wood into the cosmetic. The latter is particularly undesirable since it may impart undesirable properties to the cosmetic.

The manufacture of cosmetic pencils having a wood casing is time-consuming and costly involving selection of certain grades of wood, cutting and shaping of the wood, extrusion and cutting of the cosmetic filaments and rods and aging of the cosmetics. Additional steps may involve gluing and aging after the cosmetic has been set in place. Most of these steps require the use of costly machinery.

If the outer wood casing needs to be painted, this will require additional steps.

The use of plastics in casings for pencils is disclosed in a number of U.S. and foreign patents. These include British Pat. Nos. 1,478,202 and 1,538,188. French Pat. No. 2,359,586, German Offen. Pat. No. 27 18 957, and U.S. Pat. Nos. 3,551,064; 3,704,071; 3,875,088; 3,936,519 and 4,063,828. However, either the plastics disclosed in these patents are unsuitable for use in casings for cosmetic pencils or the information provided in respect of the composition of the plastics is so meager as to make it practically impossible to determine what exactly is being used and how it is used.

All of these patents refer to existing technologies with regard to extrusion and injection molding of plastics. This existent technology has, however, been found unsuitable for the preparation of plastic casings suitable for cosmetic pencils.

It is, accordingly, an object of the present invention to provide a cosmetic pencil whose casing is substantially inert to any of the ingredients in the cosmetic.

It is another object of the present invention to provide a cosmetic pencil whose casing, although not of wood, may be sharpened in the usual manner; e.g., using an ordinary pencil sharpener.

It is a further object of the present invention to provide a simple and inexpensive process for preparing the casings for cosmetic pencils.

It is still another object of the present invention to provide a process for filling the casings of the cosmetic pencils.

It is still a further object of the presention invention to provide a cosmetic pencil which can be readily prepared in any desired color.

The present invention provides a cosmetic pencil which comprises a casing of a polymeric material inside of which is the cosmetic and processes for the formation of the casing and filling the casing.

The casing of the present invention is obtained by preparing a homogeneous blend of the desired ingredients and injection molding the blend to a casing of desired size and shape.

The formation of the casing can also be achieved by extrusion.

While the size of the casing may be of any length and breadth, we prefer a casing whose overall length does not exceed 15 cm and whose outer diameter should be at least 8 mm. but preferably not greater than would prevent its being inserted into commonly available pencil sharpeners. The wall of the casing should have a thickness of from about 1 to 3 mm., preferably about 1.0 to 2.5 mm.

The inside of the casing has a diameter of about 5 to 6 mm. Preferably, the inside is a truncated cone with the inner diameter at the bottom being about 6.5 mm. and at the top being about 5.0 mm. Experience has shown that many of the soft cosmetic preparations currently in use exude oil which serves to act as lubricant between the cosmetic preparation and the inner wall of the casing. This lubrication frequently results in the product sliding out through the top opening in the casing. The provision of a conical shape prevents this sliding out.

The material suitable for use in the casing may be a polymer, of a mixture of polymers, which is substantially inert to the cosmetic compositions contained in the casing and sufficiently rigid to retain its shape after molding. The material should be sufficiently hard so that it can be readily sharpened, but not so hard that it resists cutting, by knives used in readily available pencil sharpeners. Materials which have a softening point above 60° C. and a hardness range of about 35–70, preferably 47–60, by the Shore Durometer D-2, ASTM D-2240 method are suitable for use in the casings of the present invention. The casing should have an outside diameter of about 10 mm.

Suitable materials having the above properties include low, medium or high density polyethylene, polypropylene, polyacrylic acids, esters and amides, oxidized polyethylene, oxidized polypropylene, and the like, and mixtures of one or more of said polymers.

Preferred materials for the casing are low density polyethylene having a density of about 0.88 to 0.95, oxidized high density polyethylene having a density of about 0.95 to 0.99 and mixtures of the two.

A suitable composition contains between 20 to 80 percent by weight of low density polyethylene having a density of about $0.93 \pm 0.02$ and 20 to 80 percent by weight of high density polyethylene having a density of about $0.97 \pm 0.02$.

Preferably, fillers such as talc, kaolin, mica, silica, calcium silicate, titanium dioxide, ferric oxide, chromium oxide, aluminum silicate (e.g., montmorillonite) and the like may be added. In addition to providing some color to the casing, such fillers impart added strength thereto. Suitable colorants, inert to the cosmetic composition, may also be added. Suitable compositions with fillers contain about 20 to 80 percent by weight of low density polyethylene, about 20 to 80 percent by weight of oxidized high density polyethylene and 2 to 20 percent by weight of a filler. When colorants are desired, they are used in up to about 2 percent by weight.

The outer portion of the casing may have any suitable cross sectional shape, such as, for example, circular, square, hexagonal or oval. Preferably, a casing of circular cross section is used.

The invention will be more fully understood from the drawings and examples which follow. These drawings and examples are given by way of illustration and are not to be considered as limiting.

In the drawings:

FIG. 1 is a perspective view of a cosmetic pencil of the present invention.

FIG. 2 is a perspective view of a capped cosmetic pencil of the present invention.

FIG. 6 is a sectional view along the line 6—6 of FIG. 3.

Figures 3, 4, 5:
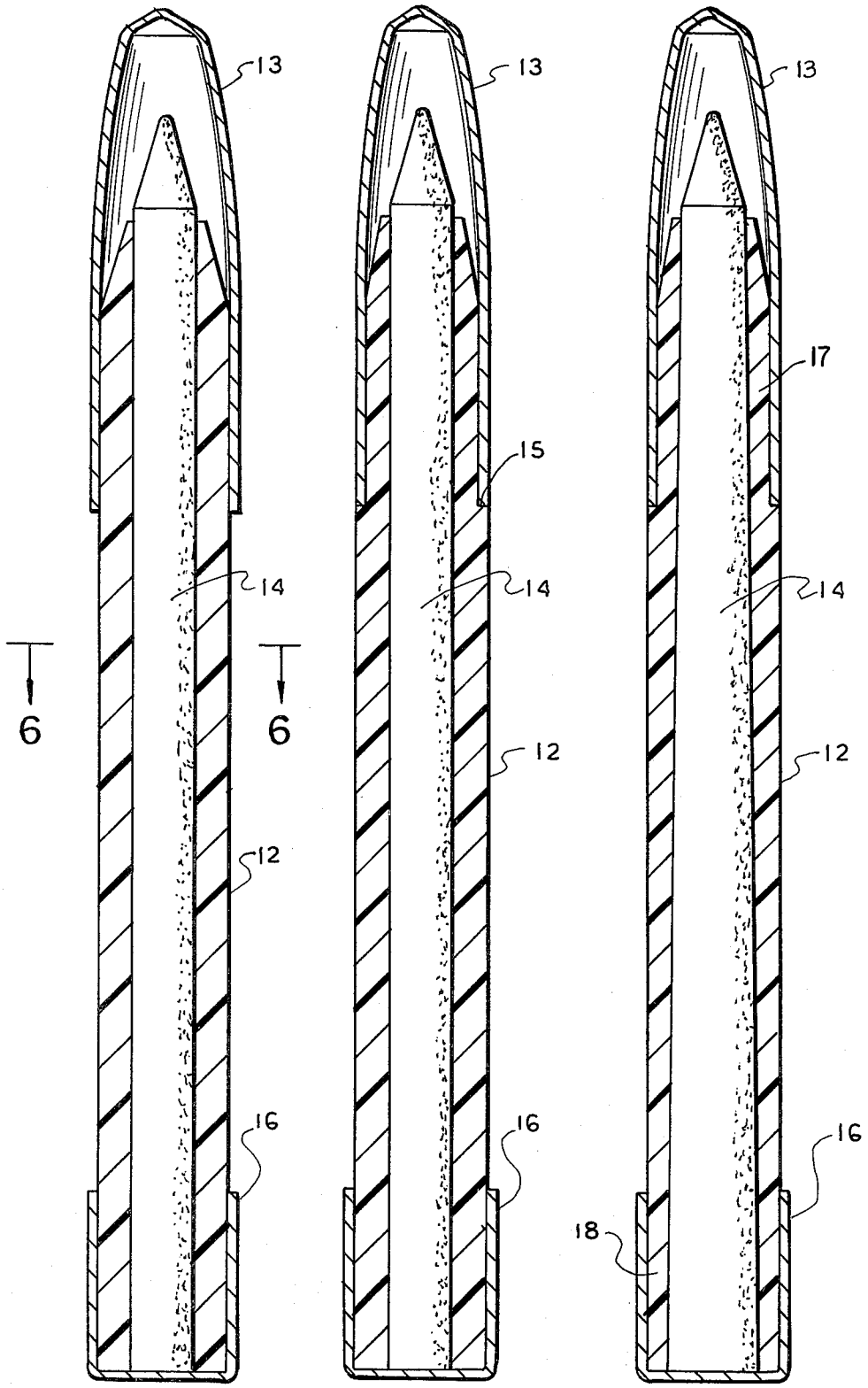
FIG. 3 is a sectional view along the line 3—3 of FIG. 2.
FIG. 4 is a sectional view similar to FIG. 3 showing a modified casing.
FIG. 5 is a sectional view similar to FIG. 3 showing a modified casing.

Referring to the drawings, the cosmetic pencil 10 of the present invention comprises an outer casing 11 having a wall 12 of the material described above. The casing may be provided with a metal cap 13. The cosmetic composition 14 is held within the casing. The top portion of the outer portion of the wall of the casing may be provided with a shoulder 15 on which a metal cap 13 fits. The bottom portion of the casing is capped with a cover 16 made of metal or plastic. Preferably, as shown in FIG. 5, the inside of the casing is tapered with the narrower portion 17 at the top and the wider portion 18 at the bottom.

Examples 1–8 illustrate the preparation of suitable casings according to the present invention, examples 9–11 illustrate cosmetic compositions suitable for use in cosmetic pencils, and examples 12 and 13 illustrate methods of filling the casing. In these examples the numerical values next to the ingredients indicate percent by weight. The density units are grams per cubic centimeter (g/cc).

EXAMPLE 1

Low density polyethylene having a density of about 0.92 was heated to 110° C. A 3-piece mold of polished aluminum was used, where a 2-piece book mold determined the outer diameter of the primary package, having a cylindrical cavity of the dimensions; diameter 1.1 cm, length 10 cm. Formation of the hollow primary was achieved by centering a solid cylinder of all polished aluminum having a diameter of 6.5 mm. and having a length of 9.5 cm. The mold was preheated, the melted polymer was poured into the hot mold, and the overflow was scrapped off. After cooling, the mold was disassembled releasing the primary package. The casing was also made by injection molding, extrusion and coextrusion. The hardness was checked according to ASTM D-2240 and had a value of 41.

By the addition of $TiO_2$ *l and/or mica to the composition for use in preparing the casing, a definitely pearlized cosmetically appealing effect was achieved. Also, due to the absorptive properties of the pigment, the physical characteristics of the molded material were altered. A casing containing* 10% of the pigment was slightly harder and slightly more brittle.

The procedure of Example 1 was used in preparing the casings of the compositions described in Examples 2 8.

EXAMPLE 2

| | |
|---|---|
| Low density polyethylene (AC-6A LDPE) | 72.0 |
| Oxidized high density polyethylene (AC-316 HDPE), density 0.99, mol. wt. 5,000 | 18.0 |
| Mica | 7.0 |

-continued

| | |
|---|---|
| Titanium dioxide | 3.0 |

EXAMPLE 3

| | |
|---|---|
| AC-6A LDPE | 70.0 |
| AC-316 HDPE | 7.0 |
| Talc | 23.0 |

EXAMPLE 4

| | |
|---|---|
| AC-6A LDPE | 70.0 |
| AC-316 HDPE | 30.0 |
| Titanated Mica | 10.0 |

EXAMPLE 5

| | |
|---|---|
| LDPE, Density 0.92, mol. wt. 2000 | 64% |
| Oxidized HDPE, density 0.98, mol. wt. 5000 | 27% |
| Filler/color: $TiO_2$/Mica/Iron Oxides | 9% |

EXAMPLE 6

| | |
|---|---|
| LDPE, density 0.94 | 40% |
| Oxidized HDPE, density, 0.98 | 50% |
| Fillers/colorants: $TiO_2$/Mica/Chrome oxide | 10% |

EXAMPLE 7

| | |
|---|---|
| LDPE, density 0.94 | 40% |
| Oxidized HDPE, density 0.98 | 40% |
| Filler/colorant: Talc/Fernic oxide | 20% |

EXAMPLE 8

| | |
|---|---|
| LDPE, density 0.94 | 20% |
| Oxidized HDPE, density 0.98 | 70% |
| Filler/colorant: $TiO_2$/Mica | 10% |

EXAMPLE 9

| Eyeshadow | |
|---|---|
| Peach Kernel Oil | 15.1 |
| Acetulated Wool Wax Alcohol | 10.8 |
| Isopropyl Palmitate | 14.0 |
| Stearic Acid | 5.0 |
| Carnauba | 5.0 |
| Beeswax | 5.0 |
| Ozokerite | 10.0 |
| Propylparaben | 0.1 |
| PHA | 0.1 |
| Hydrated Chromium Oxide | 10.0 |
| Ultramarine Blue | 10.0 |
| Mica | 8.0 |
| Titanium Dioxide | 2.0 |
| Bismuth Oxychloride | 5.0 |

EXAMPLE 10

| Lipstick | |
|---|---|
| Castor Oil | 50.0 |
| Ozokerite | 4.0 |
| Beeswax | 9.0 |
| Isopropyl Lanolate | 15.0 |
| Carnauba | 4.0 |
| Candelilla | 4.0 |
| Propylene Glycol Ester - $C_8$—$C_1O$ | 10.0 |
| Propylparaben | 0.1 |
| BHA | 0.05 |
| Para Hydroxy Toluene | 0.05 |
| Titanium Dioxide | 1.50 |
| D&C Red #6 | 0.70 |
| D&C Red #7 | 0.40 |
| Mica | 1.20 |
| | 100.00 |

EXAMPLE 11

| Eyeshadow | |
|---|---|
| Isopropyl palmitate | 10.2 |
| Lecithin | 1.0 |
| Hydrogenate Lanolin | 5.0 |
| Hydrogenated Vegetable Oil | 29.0 |
| Bentone 38 | 5.0 |
| Propylene Carbonate | 1.5 |
| Inorganic colors, q.s. shade | 10.0 |
| Mica | 18.0 |
| Preservatives, antioxidants | 0.3 |
| Ozokerite | 10.0 |
| Carnauba wax | 5.0 |
| Beeswax | 5.0 |

In filling the casings a cap is placed on the top of the casing and the casing is inverted. The cosmetic is introduced into the casing through the inverted open bottom by one of the methods described below:

(a) Hot Pour: The cosmetic formulation is heated, melted and stirred until homogeneous, (usually temperature 65°-80° C. dependant upon composition) and then directly poured into the casing. The product is allowed to cool.

(b) Extrusion: The cosmetic product is manufactured as usual, final product in molten stage passed over Roller Mill at open setting to break up structure. The "sheeted" cosmetic is stamped into cylinder and extruded into the casing.

(c) Injection Molding: Molding the cosmetic products by forcing the molten cosmetic composition under pressure into a molded casing.

EXAMPLE 12

The eyeshadow composition of Example 11 is prepared and then roller milled at an open mill setting to obtain sheeted material.

For extrusion into the casing an extruder comprised of a piston and cylinder is used. The sheeted material is compressed into the cylinder which has an opening through which the product is extruded. This opening is connected either directly or by means of an adapter to the bottom opening of the casing, so that when pressure is applied on the piston the material is extruded directly into the casing.

EXAMPLE 13

The dyes of the lipstick composition of Example 10 are dispersed in castor oil, heated to 70° C. and roller milled. The remainder of the ingredients and waxes are melted and combined with the roller milled portion.

For injection molding of the product into the cosmetic casing, a tightly sealable, electrically heated, stainless steel kettle, which is connected to an air pressure regulator gauge, is used.

On the side of the kettle is an injector nozzle which has a funnel-like adapter to accommodate the cosmetic casing. The adapter is preheated to prevent mass build up around the injector nozzle.

The product is melted in the kettle at 75°-80° C. under agitation, then air cooled to 62°-65° C. When temperature has reached 65° C., the unit kettle is tightly closed and pressurized. The product is injected through the nozzle and adapter into the cosmetic casing under 16 lbs. pressure.

After the casing has been filled with the cosmetic, the inverted bottom opening of the casing is covered with a metal or plastic cap.

We claim:

1. A cosmetic pencil capable of being sharpened in a conventional pencil sharpener, comprising a casing and a cosmetic composition core, wherein:

(a) said casing:

(i) comprises a homogeneous blend of materials, including major proportion of polyethylene whose density is in the range of between about 0.88 g/cc and 0.99 g/cc;

(ii) is made under conditions which are substantially free of blowing agents for said polyethylene, thereby providing a non-porous casing;

(iii) is inert to ingredients in said cosmetic composition;

(iv) has a hardness in the range of between about 35-70 by the Shore Durometer according to the ASTM D-2240 method enabling said casing to be smoothly and evenly sharpened in a conventional pencil sharpener without significant resistance to the cutting edge of said sharpener;

(v) has a softening point above 60° C. enabling said casing to rigidly retain its shape when in contact with hot cosmetic compositions; and, (vi) has a wall thickness sufficient to render said casing relatively inflexible at temperatures below 60° C.; and, (b) said cosmetic core composition comprises a solid cosmetic product in contact with said casing.

2. The cosmetic pencil of claim 1 wherein said density is in the range of between about 0.92 g/cc and 0.97 g/cc.

3. The cosmetic pencil of claim 2 wherein said casing material comprises said polyethylene and a filler, and wherein the relative weight proportion of said materials in said casing is:

| | | |
|---|---|---|
| (a) | polyethylene | 77-98 |
| (b) | filler | 2-23. |

4. The cosmetic pencil of claim 3 wherein said proportion is:

| | | |
|---|---|---|
| (a) | polyethylene | 77-91 |
| (b) | filler | 9-23. |

5. The cosmetic pencil of claim 3 wherein said filler is selected from talc, kaolin, mica, silica, calcium silicate, titanium dioxide, ferric oxide, aluminum silicate or titanated mica.

6. The cosmetic pencil of claim 3 wherein said casing is made under molding conditions.

7. The cosmetic pencil of claim 2 wherein said softening point is at least about 106° C.

8. The cosmetic pencil of claim 2 wherein said polyethylene comprises:

(a) 20 to 80% by weight of polyethylene having a density in the range of between about 0.88 g/cc and 0.95 g/cc; and (b) 80 to 20% by weight of polyethylene having a density in the range of between about 0.95 g/cc and 0.99 g/cc.

9. The cosmetic pencil of claim 8 wherein said casing is made under molding conditions.

10. The cosmetic pencil of claim 1 wherein said casing is made under molding conditions.

11. The cosmetic pencil of claim 1 wherein the bottom portion of said casing is capped with a cover.

12. The cosmetic pencil of claim 1 wherein said casing and core have circular cross-sections.

13. The cosmetic pencil of claim 12 comprising a top portion and a bottom portion and wherein the inside of said casing is tapered with the more narrow section being at the top portion and the wider section being at the bottom portion.

14. The process of preparing a cosmetic pencil capable of being sharpened in a conventional pencil sharpener, comprising a casing and a cosmetic composition core, wherein said casing:

(i) comprises a homogeneous blend of materials, including major proportion of polyethylene whose density is in the range of between about 0.88 g/cc and 0.99 g/cc;

(ii) is made under conditions which are substantially free of blowing agents for said polyethylene, thereby providing a non-porous casing;

(iii) is inert to ingredients in said cosmetic composition;

(iv) has a hardness in the range of between about 35–70 by the Shorre Durometer according to the ASTM D-2240 method enabling said casing to be smoothly and evenly sharpened in a conventional pencil sharpener without significant resistance to the cutting edge of said sharpener;

(v) has a softening point above 60° C. enabling said casing to rigidly retain its shape when in contact with hot cosmetic compositions; and, (vi) has a wall thickness sufficient to render said casing relatively inflexible at temperatures below 60° C.; and, said cosmetic core composition comprises a solid cosmetic product in contact with said casing, said process comprising the steps of:

(a) forming a hollow core-containing casing of a homogeneous blend of materials, including major proportion of polyethylene whose density is in the range of between about 0.88 g/cc and 0.99 g/cc, under conditions which are substantially free of blowing agents for said polyethylene, thereby forming a non-porous casing; and (b) filling said hollow core of said casing with a cosmetic composition.

15. The process of claim 14 wherein said forming steps comprise:

(a) molding said casing by pouring said polyethylene in melted form into the hot mold for said casing; and (b) cooling said mold.

16. The process of claim 15 wherein said density is in the range of between about 0.92 g/cc and 0.97 g/cc.

17. The process of claim 14 wherein said casing is formed by injection molding.

18. The process of claim 14 wherein the said casing is formed by extrusion.

19. The process of claim 14 wherein said cosmetic composition is:

(a) heated until melted;

(b) stirred until homogeneous;

(c) poured into said casing; and (d) cooled.

20. The process of claim 14 wherein said cosmetic composition is extruded into said casing.

21. The process of claim 14 wherein said cosmetic composition is injection molded into said casing.

22. The process of claim 14 wherein said casing and core are formed with circular cross-sections.

23. The process of claim 14 wherein said density is in the range of between about 0.92 g/cc and 0.97 g/cc.

* * * * *